United States Patent [19]

Savins

[11] 4,356,866

[45] Nov. 2, 1982

[54] PROCESS OF UNDERGROUND COAL GASIFICATION

[75] Inventor: Joseph G. Savins, Dallas, Tex.

[73] Assignee: Mobil Oil Corporation, New York, N.Y.

[21] Appl. No.: 221,725

[22] Filed: Dec. 31, 1980

[51] Int. Cl.[3] ..... C10J 5/00; E21B 43/243

[52] U.S. Cl. ..... 166/261; 166/50

[58] Field of Search ..... 166/256, 261, 271, 245, 166/259, 251, 50, 52; 299/2

[56] References Cited

U.S. PATENT DOCUMENTS

| | | | |
|---|---|---|---|
| 2,481,051 | 9/1949 | Uren | 299/2 |
| 2,561,639 | 7/1951 | Squires | 166/256 X |
| 3,497,335 | 2/1970 | Taylor | 166/256 X |
| 3,865,186 | 2/1975 | Hippel et al. | 166/256 |
| 3,933,447 | 1/1976 | Pasini et al. | 299/2 X |
| 3,997,005 | 12/1976 | Komar | 166/256 X |
| 4,069,867 | 1/1978 | Bissett | 166/256 |
| 4,095,650 | 6/1978 | Shuck | 166/256 |
| 4,222,437 | 9/1980 | Sabol | 166/256 X |

*Primary Examiner*—Stephen J. Novosad

*Attorney, Agent, or Firm*—Charles A. Huggett; James F. Powers, Jr.; Lawrence O. Miller

[57] ABSTRACT

Useful product is recovered from an underground coal seam by drilling a passage extending from the surface to a cavity formed in the floor rock below the coal seam, drilling one or more upwardly radially extending channels from the cavity forming an injection manifold-like system which extends to the interface between the floor rock and the coal seam, injecting an oxidant or oxidant gas mixture into these channels from the surface, igniting the coal where the radially extending channels connect with the base of the coal seam and recovering product gases generated by the gasification process through a plurality of surrounding production wells.

20 Claims, 3 Drawing Figures

PROCESS OF UNDERGROUND COAL GASIFICATION

BACKGROUND OF THE INVENTION

1. Field of the Invention

The present invention relates to a method for gasifying coal in-situ and transporting the generated product gases to the earth's surface. More particularly, the invention relates to a novel and improved method for in-situ coal gasification which utilizes a radially-disposed oxidant gas or oxidant mixture injection manifold-like system embedded in the floor rock beneath the coal seam wherein the coal is ignited at the interface of the coal seam and the floor rock and product gases are recovered at production wells.

2. Description of the Prior Art

Underground coal gasification (UCG) is a conceptually simple process for the in-situ extraction of coal values. In its most general form, a pair of process wells (an injector and a producer) some specified distance apart, is drilled from the surface into the coal seam. A combustible material, e.g., charcoal, fuel oil, etc., or an electrical resistance heater, is inserted into one well to ignite the coal. Oxidant gas (usually air, or oxygen-enriched air) injected at high pressure and low volume rate is injected into the other well, permeates the coal seam, draws the flame toward the second well (by a process of reverse combustion) and in effect forms a permeable linkage between the wells. The coal seam may also be prepared and the wells linked by directional drilling, hydraulic or explosive fracturing, electrolinking, etc. Of these various methods, the method which seems least dependent on seam characteristics is directional drilling from the surface to construct a horizontal channel between the wells. Once linked, an oxidant blast (consisting of air or a mixture of steam and oxygen) is injected at high rate and low pressure into one of the process wells, and forward gasification commences, consuming the bulk of the coal between the wells and generating a mixture of combustible gases (CO, $CH_4$, $H_2$) and other materials ($H_2O$, $CO_2$, char, coal, $H_2S$, tars, etc.), which exit to the surface by way of the second process well. There are disadvantages to conventional UCG operations in which the process wells only extend into the coal seam to a depth substantially above the base of the seam, or in which the method used to prepare and link the wells does not produce a reliable permeable path at the base of the coal seam, or in which the oxidant mixture is injected into the seam by piping which is a part of the process wells described above. It is well known from US-UCG experiences, in particular, that if the linkage path forms near the top of the coal, gasification reactions quickly proceed to the interface between coal and overlying roof rock. Poor sweep results, bypassing and an override condition by the injected oxidant occurs, bypassing of hot product gases occurs and devolatilization of the coal prior to gasification is inhibited, heat loss to the roof becomes significant, and a significant portion of the resource is not utilized. Additionally, and most importantly, as a result of the override conditions and the excessive temperatures produced above the bulk of the coal, the oxidant injection system can be damaged or destroyed, process well longevity drastically shortened, and excessive oxidant consumption results. The locally high temperatures may exacerbate roof collapse and promote unwanted or uncontrolled in-situ water intrustion.

Although there is prior art disclosing a radially-disposed oxidant gas or oxidant mixture injection system for in-situ coal gasification as shown in U.S. Pat. No. 3,506,309, no art exists showing such a system embedded in floor rock beneath the coal seam to be gasified. In the aforementioned patent, there is shown an injection well connected to a plurality of radially-disposed production wells. However, none of the inlet channels in this disclosure extend into the floor rock beneath the coal seam.

SUMMARY OF THE INVENTION

The present invention provides an improved process of in-situ coal gasification which permits the economical recovery of gases from thick underground coal seams and has numerous advantages over processes proposed in the past. It comprises a manifold-like oxidant gas injection system embedded in the floor rock beneath the coal seam, and consists of channels that radially extend upwardly from a central cavity in the floor rock underlying the coal seam to the interface between the floor rock and the coal seam, an oxidant injection borehole extending from the earth's surface and which connects with the central cavity, and a plurality of production wells surround the injection manifold in a ring pattern to recover the UCG product gases. In this process, the oxidant gas such as air, or a mixture of steam and oxygen is injected into the base of the coal seam through the manifold system, the coal is ignited at the base of the seam and the product (a mixture of methane, hydrogen, carbon dioxide, water, carbon monoxide and other materials including a substantial amount of nitrogen if air is injected), is recovered through the plurality of production wells. My process permits the gasification process to begin at the bottom of the coal seam which avoids many of the difficulties characterized by in-situ processes for the recovery of gases from coal in the past. As a result of in-situ gasification utilizing a radially-disposed oxidant gas injection system embedded in the floor rock beneath the coal seam, and the deviated oxidant injection borehole, the oxidant mix is pinned to the base of the coal and reactions are initially confined to this region. Sweep efficiency is improved since gasification proceeds radially outward and laterally along radii. Oxygen consumption is reduced since there is more controlled contact of hot product gases with the coal and bypassing of these gases is reduced or minimized. Efficient extraction of pyrolysis products results. Heat loss is minimized since ignition begins at the base of the coal seam and the entire coal seam is uniformly heated from bottom to top. Therefore, less heat is lost to the overburden. Plugging of the oxidant gas injection passages by slag is reduced by this process. Obviously, this process eliminates burn override conditions of the early critical stages of the process, and casing and oxygen lance burnoff up in the coal seam is not a factor.

DESCRIPTION OF THE PREFERRED EMBODIMENT

Figure 1:
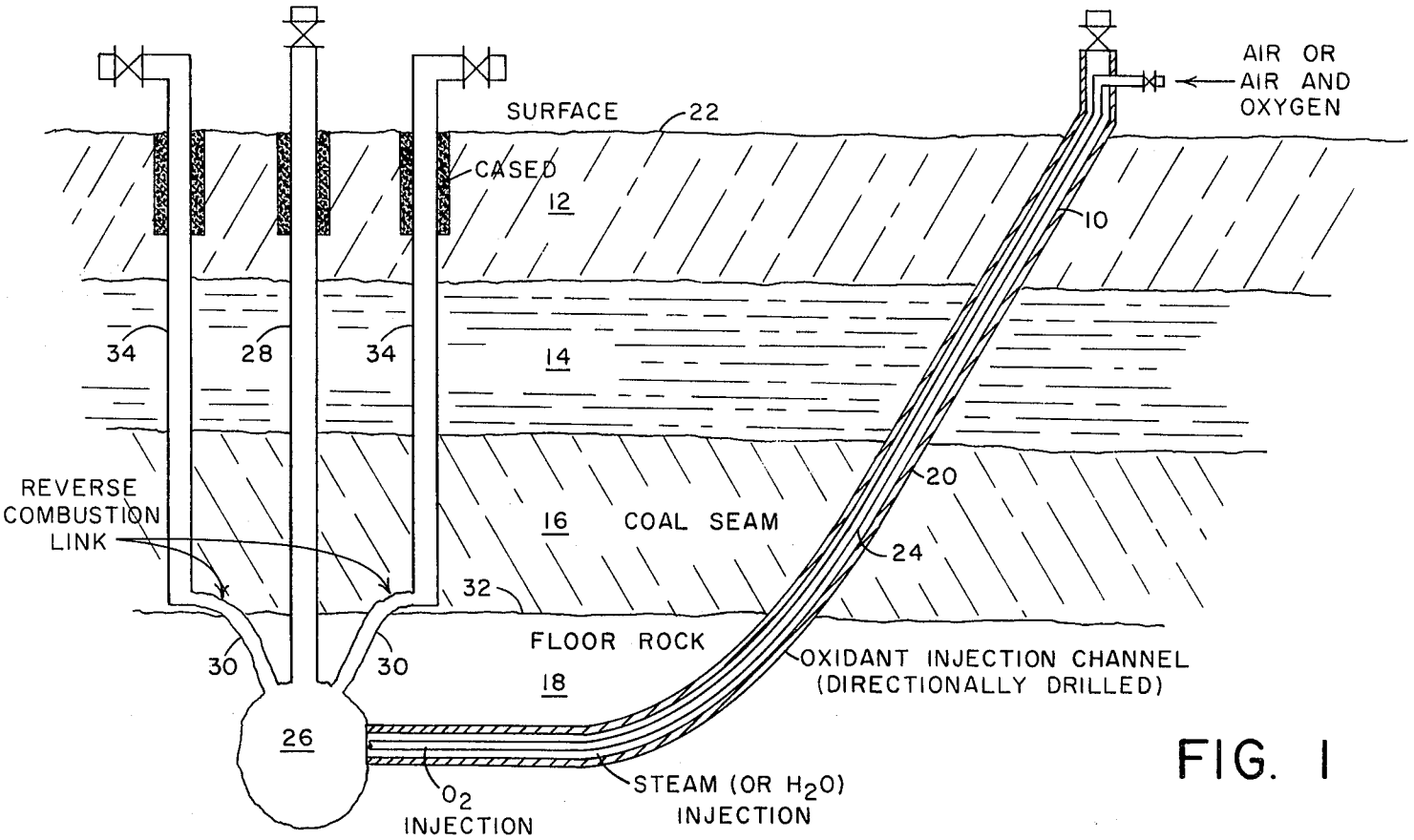
FIG. 1 is a vertical sectional view of the manifold-like injection well beneath the floor rock and the production wells penetrating a coal formation illustrating the invention.

Referring to FIG. 1, a deviated borehole 10 is drilled from the earth's surface through overburden 12 and 14 comprised of several lithologic units, through the coal seam 16 and extending into the floor rock 18 in a direction generally paralleling the dip of the seam. Borehole 10 is equipped with a casing 20 extending to the upper level of stratum 22. Borehole 10 is shown provided with a central tubing string 24 so that oxidant may be injected through the tubing as well as through the annular channel between the borehole and the tubing. When only one passage is used to inject oxidant or oxidant mix, the other channel may be used to inject materials to assist in the control of the gasification process.

A cavity or manifold 26 is drilled from a vertical shaft 28 extending from the surface which connects with borehole 10 and is located entirely in the floor rock 18 below the coal seam 16 at a distance which does not exceed the thickness of the coal seam 16. A plurality of radially extending injection channels 30 are drilled from the cavity 26 which extend upwardly to the interface 32 between the coal seam 16 and the floor rock 18.

Although FIG. 1 illustrates a plurality of injection channels 30, which is the preferred embodiment, it is to be understood that the invention is not limited to more than one channel. Consequently, only one injection channel 30 could be drilled which would not effect the advantages of this process. These channels 30 can be formed by directional drilling, or by hydraulically assisted methods such as a borehole slurry miner or an around-the-corner miner. Production boreholes or wells 34 are drilled from the surface 22 to near the bottom of the coal seam 16. The design of these process wells must anticipate UCG process conditions and hence may include the use of full or partial liners to insure the reliability of the well, specially designed suspension systems to allow vertical displacement, multiple tubing strings to provide annular passages to act as insulating barriers or to provide channels for injecting materials to control exit gas temperature, etc. As such, the configuration illustrated is not intended to address these points but merely to provide a schematic of the production well. Wells 34 are located approximately 60 to 250 feet spaced laterally in a ring pattern from the center of cavity 26. For each channel 30, there is a production well 34 that is laterally spaced apart from the channel and lying approximately on the same radius as the channel.

Figure 2:
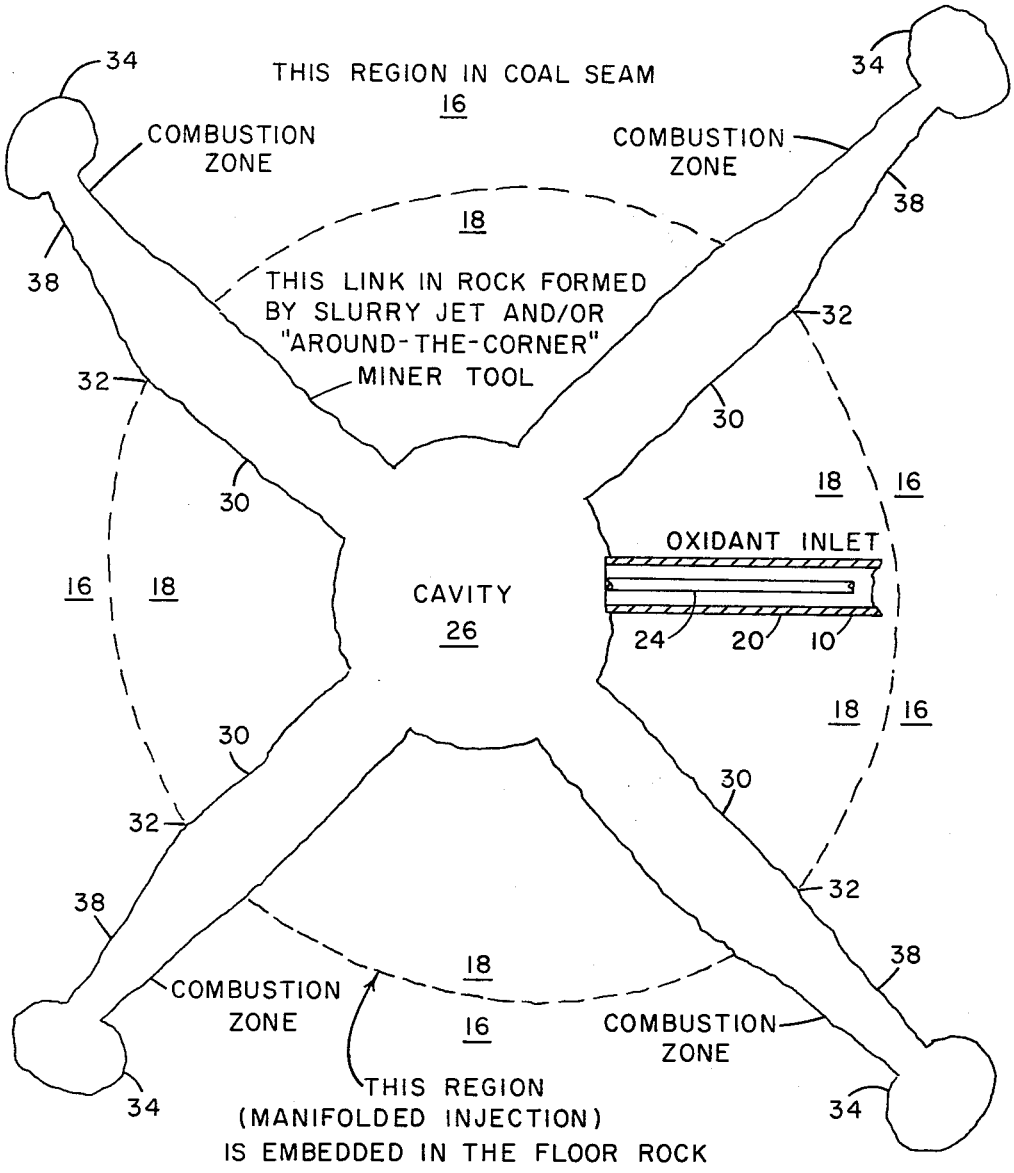
FIG. 2 is a diagrammatic top plan view of the injection manifold and the gasification zones extending to the production wells.

FIG. 2 is a plan view showing the cavity 26 with injection channels that radially extend from the cavity to the interface of the floor rock 18 and the coal seam 16. Production wells 34 surround injection channels 30 and for each injection channel 30 there is a laterally spaced production well 34 lying approximately on the same radii and linked to each other by channels 38.

Referring to FIG. 2, the cavity 26 formed in the floor rock below the coal seam connects with the interface 32 between the coal seam and floor rock by means of radially extending injection channels 30. Since the permeability of the coal is in general not sufficient to permit effective gasification between the injection channels 30 and production wells 34, it therefore becomes necessary to provide an initial passageway between these boreholes. This can be accomplished by the use of directional drilling, or the passageways may be formed by burning using a technique known as reverse combustion. By this technique, ignition of the coal is initiated about the production wells 34 by use of chemical or electrical means and an oxidant gas or oxidant mixture is fed through the stratum to the production wells 34 from injection channels 30 and injection well 20. The combustion zone moves from production wells 34 toward an injection channel 30 lying on the same radii. Hot production gases pass through production wells 34 behind the combustion front. After the combustion front reaches injection channels 30, linkage channels 38 are formed between the injection channels 30 and production wells 34 lying on the same radii. Once this link is effected, forward gasification is initiated by injecting an oxidant gas or oxidant mixture into the radially-disposed manifold system consisting of cavity 26 and channels 30 through tubing string 24 in injection well 20 and product gases are recovered from production wells 34. The combustion zone moves laterally and vertically from channels 30 toward production wells 34. A coolant, such as water may also be injected down the annulus of injection well 20 to prevent plugging of the injection channel 30 caused by the formation of slag at high temperatures.

Figure 3:
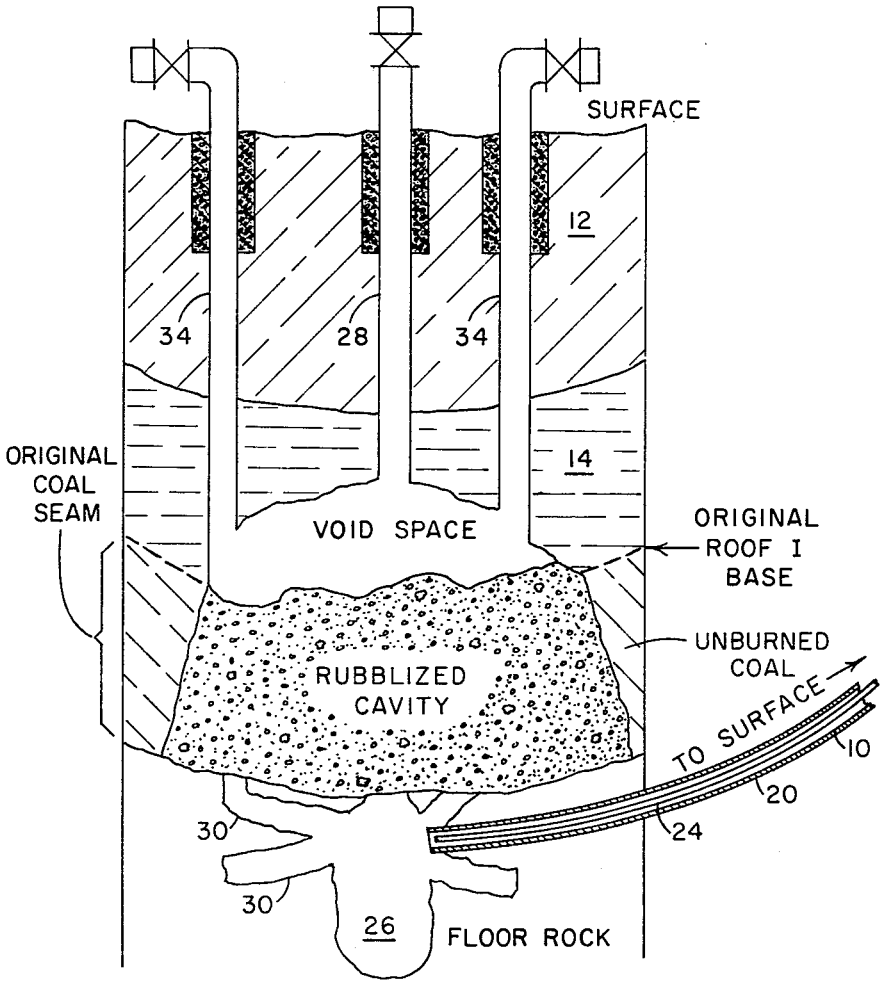
FIG. 3 is a vertical sectional view of the coal seam and overlying formation after combustion of the coal seam below the production wells.

FIG. 3 illustrates the configuration of the process at the end of gasification. The radially disposed oxidant injector system and the injection borehole 10 are unaffected by the gasification process of roof collapse. Burn-off of the oxidant injector or lance is eliminated since it is isolated from the process and embedded in floor rock unaffected by the burn. Excessive heat loss is eliminated, and the entire coal seam is uniformly heated from bottom to top. Plugging from slagging conditions is reduced due to the series of oxidant gas or oxidant mixture injection channels extending from the manifold system below the coal seam. Oxidant bypassing is minimized due to the position of the injection borehold 10 being pinned to the base of the coal seam.

Gasification continues until the volume of coal above the injection manifold has been extracted as illustrated in FIG. 3 of the drawing. The volume of the cavity thus formed will depend in part upon the height of the coal seam and the distance the production wells 34 are laterally spaced apart from central cavity 26. During gasification, a rubblized zone (comprised of unburned coal, ash, char, rock) of high permeability is formed. The tortuous flow path offers a number of advantages: minimizes bypassing of injected oxidant, insures intimate contact between hot gases and coal, creates a large surface area that results in efficient gas-solid reactions, reduces heat losses, and creates a reduction zone where much of the useful product is formed. After the coal has been extracted, the injection of oxidant gas or oxidant mixture into the seam through the injection channels 30 is terminated.

In another embodiment of the invention, direct drive in-situ combustion may be possible when the permeability of the coal seam is high enough. This eliminates the need to establish linkage channels 38 shown in FIG. 3 between injection channels 30 and production wells 34. In such an application of the invention, an oxidant or oxidant mixture is fed through injection channels 30 from injection well 10 and the coal ignited around the walls of the injection channels 30 at the interface of the coal seam 16 and the floor rock 18. Product gases are removed from production wells 34 and direct drive of the combustion zone to production wells 34 is effected by continuing the injection of an oxidant gas or oxidant mixture through injection channels 30. Gasification continues until the volume of coal above the injection manifold has been extracted as illustrated in FIG. 3.

I claim:

1. A method for gasifying underground coal seams by in-situ gasification which comprises providing a cavity in the floor rock underlying the coal formation, providing a deviated injection borehole extending from the earth's surface and communicating with said cavity, providing at least one upwardly radially extending injection channel that communicates the cavity with the coal seam at the interface of the coal seam and the floor rock underlying the coal seam, providing at least one production well for each injection channel, said production well extending from the earth's surface and communicating with said coal seam near the base of the formation and laterally spaced apart from said injection channel and lying approximately on the same radii as said injection channel, injecting an oxidant in said injection well igniting said coal seam in said injector channel to form a gasification zone and generate hot product gases at the interface of said coal seam and the floor rock underlying the coal formation, continuing to inject said oxidant to propagate said gasification zone through said seam in a direction toward the production well and producing said hot product gases into said production well.

2. A method as defined in claim 1, wherein said cavity is located a distance below the coal seam which does not exceed the thickness of the coal seam.

3. A method as defined in claim 1, wherein the production well is spaced laterally from 60 to 250 feet from said cavity.

4. A method as defined in claim 1, wherein said oxidant is an oxygen-containing gas.

5. A method as defined in claim 1, wherein said oxidant is a mixture of an oxygen-containing gas and steam.

6. A method for extracting coal values in-situ by in-situ gasification which comprises providing a cavity in the floor rock underlying the coal seam, providing an offset injection well extending from the earth's surface and communicating with said cavity, providing at least one upwardly radially extending injection channel that communicates the cavity with the coal formation at the interface of the coal seam and the floor rock underlying the coal seam, providing at least one production well for each injection channel, said production well extending from the earth's surface and communicating with said coal seam near the base of the seam and laterally spaced apart from said injection channel and lying approximately on the same radii as the injection channel, providing a channel through said coal seam to communicate the production well and the injector channel lying on the same radii, injecting an oxidant in said injection well, igniting said coal seam in the injection channel to form a gasification zone and generate hot product gases at the interface of said coal seam and the floor rock underlying the coal seam, continuing to inject said oxidant gas or oxidant gas mixture to propagate said gasification zone through said seam in a direction toward the production well and producing said hot product gases into said production well.

7. A method as defined in claim 6, wherein said cavity is located a distance below the coal seam not greater than the thickness of the coal formation.

8. A method as defined in claim 6, wherein the production well is spaced laterally from 60 to 250 feet from said cavity.

9. A method as defined in claim 6, wherein said oxidant is an oxygen-containing gas.

10. A method as defined in claim 6, wherein said oxidant is a mixture of an oxygen-containing gas and steam.

11. A method for gasifying underground coal seams by in-situ gasification which comprises providing a cavity in the floor rock underlying the coal seam, providing a plurality of upwardly radially extending spaced injection channels that communicate the cavity with the coal seam at the interface of the coal seam and the floor rock underlying the coal seam, providing an injection well extending from the earth's surface and communicating with said cavity, providing a plurality of production wells equal to the number of said injection channels, said production wells extending from the earth's surface and communicating with said coal seam near the base of the seam, said production wells surrounding said cavity and substantially concentric therewith and laterally spaced apart from said injection channels and lying approximately on the same radii as said injector channels, injecting an oxidant in said injection well, igniting said coal seam in the injection channels to form a gasification zone and to generate hot product gases at the interface of said coal seam and the floor rock underlying the coal seam, continuing to inject said oxidant gas or oxidant gas mixture to propagate said gasification zone through said seam in a direction toward the production well and producing said hot product gases into said production well.

12. A method as defined in claim 11, wherein said cavity is located a distance below the coal seam not greater than the thickness of the coal seam.

13. A method as defined in claim 11, wherein production well is spaced laterally from 60 to 250 feet from said cavity.

14. A method as defined in claim 11, wherein said oxidant is an oxygen-containing gas.

15. A method as defined in claim 11, wherein said oxidant is a mixture of an oxygen-containing gas and steam.

16. A method for gasifying underground coal seams by in-situ gasification which comprises providing a cavity in the floor rock underlying the coal seam, providing a plurality of upwardly radially extending spaced injection channels that communicate the cavity with the coal seam at the interface of the coal seam and the floor rock underlying the coal seam, providing an injection well extending from the earth's surface and communicating with said cavity, providing a plurality of production wells equal to the number of said injection channels, said production wells extending from the earth's surface and communicating with said coal seam near the base of the seam, said production wells surrounding said cavity and substantially concentric therewith and laterally spaced apart from said injection channels and lying approximately on the same radii as said injection channels, providing a channel through said coal seam to communicate a production well and an injection channel lying on the same radii, injecting an oxidant in said injection well, igniting said coal seam in the injection channels to form a gasification zone and to generate hot product gases at the interface of said coal seam and the floor rock underlying the coal seam, continuing to inject said oxidant gas or oxidant gas mixture to propagate said combustion zone through said seam in a direction toward the production well and producing said hot product gases into said production well.

17. A method as defined in claim 16, wherein said cavity is located a distance below the coal seam not greater than the thickness of the coal seam.

18. A method as defined in claim 16, wherein production well is spaced laterally from 60 to 250 feet from said cavity.

19. A method as defined in claim 16, wherein said oxidant is an oxygen-containing gas.

20. A method as defined in claim 16, wherein said oxidant is a mixture of an oxygen-containing gas and steam.

* * * * *